United States Patent [19]

Baba et al.

[11] Patent Number: 4,939,762

[45] Date of Patent: Jul. 3, 1990

[54] TARGET FOR X-RAY TUBE AS WELL AS METHOD OF MANUFACTURING THE SAME, AND X-RAY TUBE

[75] Inventors: Noboru Baba, Hitachiohta; Yusaku Nakagawa, Hitachi; Masatake Fukushima, Katsuta; Masateru Suwa, Naka; Ichiro Inamura, Mobara, all of Japan

[73] Assignees: Hitachi, Ltd.; Hitachi Medical Corporation, both of Tokyo, Japan

[21] Appl. No.: 275,534

[22] PCT Filed: Mar. 18, 1988

[86] PCT No.: PCT/JP88/00289

§ 371 Date: Nov. 15, 1988

§ 102(e) Date: Nov. 15, 1988

[87] PCT Pub. No.: WO88/07260

PCT Pub. Date: Sep. 22, 1988

[30] Foreign Application Priority Data

Mar. 18, 1987 [JP] Japan ..... 62-60996

[51] Int. Cl.[5] ..... H01J 35/10

[52] U.S. Cl. ..... 378/144; 378/143; 378/127; 378/125

[58] Field of Search ..... 378/125, 127, 143, 144

[56] References Cited

U.S. PATENT DOCUMENTS 3,579,022 5/1971 Hennig et al. ..... 378/144

3,894,239 7/1975 Braun ..... 378/144

4,352,041 9/1982 Hübner et al. ..... 378/125

*Primary Examiner*—Carolyn E. Fields

*Assistant Examiner*—David P. Porta

*Attorney, Agent, or Firm*—Antonelli, Terry, Stout & Kraus

[57] ABSTRACT

An X-ray target having a graphite body and an X-ray generating metal coating layer, in that a metal interlayer which is non-reactive with graphite and which has a coefficient of thermal expansion substantially equal to those of the graphite and the X-ray generating metal coating layer is formed at the boundary between the graphite body and the X-ray generating metal coating layer, and that the interlayer is caused to percolate into the graphite body. Desirably, the interlayer includes a part percolating into the graphite body over a depth of at least 10 μm. The X-ray target can be manufactured in such a way that the surface of the graphite body is coated with the metal interlayer by subjecting the surface to chemical vapor deposition under a normal pressure or under a pressure near the normal pressure, and that the metal interlayer is thereafter coated with an X-ray generating metal by an expedient such as chemical vapor deposition, sputtering or thermal spraying. Owing to the percolation of the metal interlayer into the graphite body, the contact area of the two increases conspicuously, and heat having developed in the X-ray generating metal coating layer is quickly transmitted to the graphite body.

26 Claims, 3 Drawing Sheets

TARGET FOR X-RAY TUBE AS WELL AS METHOD OF MANUFACTURING THE SAME, AND X-RAY TUBE

TECHNICAL FIELD

The present invention relates to an X-ray target for use in X-ray tubes, a method of manufacturing the target, a rotating anode comprising the target, and an X-ray bulb as well as an X-ray tube in which such a rotating anode is built.

The X-ray tube of the present invention is well suited for application to the X-ray CT (the abbreviation of "Computed Tomography") system of medical equipment.

BACKGROUND ART

Examples of an X-ray target for use in an X-ray tube are described in the official gazette of Japanese patent application Publication No. 8263/1972. In this official gazette, there is disclosed the X-ray target of the structure wherein graphite forms a body, and only a part to be irradiated with an electron beam and the vicinity thereof are coated with a tungsten-rhenium alloy. Also, there is disclosed the X-ray target of the structure wherein an interlayer of rhenium is interposed between the graphite body and the tungsten-rhenium alloy coating layer. It is stated that, in the X-ray targets of these structures, the large heat capacity of the graphite protects the tungsten-rhenium alloy coating layer from a thermal excessive load.

The official gazette of Japanese patent application Laid-open No. 202643/1985 discloses the structure of an X-ray bulb which is furnished with an X-ray target. The official gazette of Japanese patent application Laid-open No. 183861/1986 discloses an example of the structure of an X-ray tube which has a built-in X-ray bulb.

Properties required of the X-ray CT system of medical equipment are shortening a diagnosing period of time, clearing a processed image, etc.

For meeting these requirements, the emission amount of X-rays needs to be enlarged by increasing the input of an X-ray tube.

An X-ray target receives an electron beam from a cathode thereby to generate X-rays In generating the X-rays, most of the electron beam is converted into heat, and the X-ray target is heated to a high temperature. The heated temperature of the X-ray target rises with the increase of the input.

The inventors' study has revealed that, in the X-ray target wherein the body is made of graphite, and the part on which an electron beam impinges is coated with the X-ray generating metal material as in the invention described in the official gazette of Japanese patent application Publication No. 8263/1972, the conductivity of heat from the X-ray generating metal coating layer to the graphite body is inferior, so the X-ray generating metal coating layer becomes liable to peel off the graphite body when the input increases.

In this manner, the prior-art X-ray target cannot effectively utilize the large heat capacity which the graphite possesses.

DISCLOSURE OF THE INVENTION

An object of the present invention is to provide an X-ray target in which an X-ray generating metal coating layer is less liable to peel off than in the X-ray target described in the official gazette of Japanese patent application Publication No. 8263/1972, so that the input of a tube can be increased more.

Another object of the present invention is to provide a method of manufacturing an X-ray target in which the adhesion between an X-ray generating metal coating layer and a graphite body is favorable, and besides, heat having developed in the X-ray generating metal coating layer can be quickly transmitted to the graphite body.

Still another object of the present invention is to provide an X-ray bulb and an X-ray tube each of which comprises such an X-ray target.

In an X-ray target having a graphite body and an X-ray generating metal coating layer which covers the part of the body to be bombarded with an electron beam and the vicinity thereof, the present invention consists in that a metal interlayer which is nonreactive with graphite and which has a coefficient of thermal expansion substantially equal to those of the graphite and the X-ray generating metal coating layer is formed at the boundary between the graphite body and the X-ray generating metal coating layer, and that the interlayer is caused to percolate into the graphite body. The interlayer should desirably have a part which percolates over a depth of at least 10 μm (hereinbelow, the part shall be termed the "maximum percolation depth").

The X-ray target of the present invention can be manufactured in such a way that the surface of the graphite body is subjected to chemical vapor deposition under a normal pressure or a pressure near the normal pressure, thereby to be coated with the metal interlayer, and that the metal interlayer is thereafter coated with an X-ray generating metal by an expedient such as chemical vapor deposition, sputtering or thermal spraying By performing the chemical vapor deposition under or near the normal pressure, the metal interlayer is permitted to percolate into the graphite body.

In the X-ray target of the present invention, the X-ray generating metal coating layer is less liable to peel off than in the prior-art X-ray target already stated. This effect is based on the fact that the metal interlayer has percolated into the graphite body.

Owing to the percolation of the metal interlayer into the graphite body, the contact area of the two increases remarkably, and heat having developed in the X-ray generating metal coating layer is quickly transmitted to the graphite body.

Moreover, the metal interlayer having percolated into the graphite body has a function as a wedge and renders the X-ray generating metal coating layer difficult of peeling off the graphite body.

According to the inventors' experiment, when the metal interlayer was not caused to percolate into the graphite body, a tube voltage and a tube current at limits which were allowed for an X-ray tube without the peeling of the X-ray generating metal coating layer were about 120 kV and 350 mA, respectively.

In contrast, with the X-ray target in which the metal interlayer was caused to percolate into the graphite body, an X-ray tube could be loaded with a tube voltage of 120 kV and a tube current of 600 mA.

The present invention also consists in a rotating anode for an X-ray tube having an X-ray target which emits X-rays upon irradiation with an electron beam, and a mechanism which rotates the target; the rotating mechanism including a rotary shaft of the target, a cylindrical motor rotor that is fixed to the rotary shaft, a stationary shaft that surrounds the rotary shaft and supports this rotary shaft, and a bearing that intervenes between the stationary shaft and the rotary shaft; characterized in that said X-ray target comprises an X-ray generating metal coating layer made of either of a tungsten-rhenium alloy and tungsten at an electron-beam irradiation face of a graphite body, and an interlayer of rhenium at a boundary between said coating layer and said body, and that a maximum percolation depth of the rhenium into said graphite body is at least 10 μm.

Further, the present invention consists in an X-ray bulb having within a vacuum tube a cathode which radiates an electron beam, and a rotating anode which includes an X-ray target for emitting X-rays upon irradiation with the electron beam and a mechanism for rotating the target; the rotating mechanism including a rotary shaft of the X-ray target, a stationary shaft that surrounds the rotary shaft and supports this rotary shaft, and a bearing that intervenes between both the shafts; characterized in that said X-ray target comprises an X-ray generating metal coating layer made of either of a tungsten-rhenium alloy and tungsten at an electron-beam irradiation face of a graphite body, and an interlayer of rhenium at a boundary between said coating layer and said body, and that a maximum percolation depth of the rhenium into said graphite body is at least 10 μm.

Further, the present invention consists in an X-ray tube having an X-ray bulb, and a cooling medium which fills up a space around the X-ray bulb, within a sealed envelope which has an X-ray emission window; the X-ray bulb including within a vacuum tube a cathode that radiates an electron beam, and a rotating anode that includes an X-ray target for emitting X-rays upon irradiation with the electron beam and a mechanism for rotating the target; the rotating mechanism including a rotary shaft of the X-ray target, a stationary shaft that surrounds the rotary shaft and supports this rotary shaft, and a bearing that intervenes between both the shafts; characterized in that said X-ray target comprises an X-ray generating metal coating layer made of either of a tungsten-rhenium alloy and tungsten at an electron-beam irradiation face of a graphite body, and an interlayer of rhenium at a boundary between said coating layer and said body, and that a maximum percolation depth of the rhenium into said graphite body is at least 10 μm.

By the way, the electron-beam irradiation face of the X-ray target may well be formed into a double layer structure which consists of a top layer made of a tungsten-rhenium alloy and a bottom layer made of tungsten.

BRIEF DESCRIPTION OF THE DRAWINGS

FIGS. 1 and 2 are schematic sectional views of an X-ray target according to an embodiment of the present invention, in which FIG. 1 shows a partial enlarged sectional view, while FIG. 2 shows a general sectional view.

FIG. 5 is a schematic sectional view showing an embodiment of an X-ray tube of the present invention, while

BEST MODES FOR CARRYING OUT THE INVENTION

(i) Construction of X-ray Target

Figure 1:
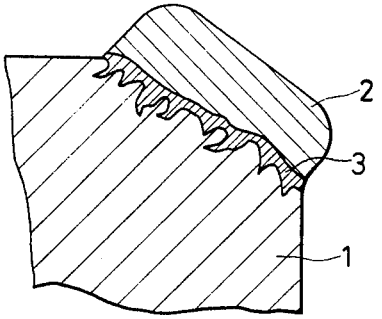

The X-ray target of the present invention has its body made of graphite. As compared with metal, the graphite body has a larger heat capacity and also exhibits a superior heat conductivity. Moreover, it is lighter in weight. This merit of the lighter weight permits the X-ray target of the present invention to be used merely by assembling it into the X-ray bulb of the structure as described in the official gazette of Japanese patent application Laid-open No. 202643/1985, and brings forth the effect that a tube input can be increased.

The graphite body need not always be made of only graphite It may well be prepared by mixing graphite and metal powder and then sintering the mixture. By way of example, a body which is made of a sintered compact composed of graphite and tungsten powder has a superior heat conductivity and also a high strength, so that it is satisfactorily usable as the body of the X-ray target according to the present invention. The proportion of the metal powder for the sintered compact composed of the graphite and the metal powder ought to be considered and determined so that the heat capacity inherent in the graphite itself may not be spoilt much. It is desirable that the proportion of the graphite exceeds 50% in the volumetric ratio.

Alternatively, the body may well be put into a laminated structure by stacking a sheet of graphite and a sheet made of another material. As the other material in this case, any of metal, ceramics, etc. can be used. The strength of the body can be raised in such a way that the body is constructed by stacking the graphite sheet and a sheet made of a heat-conductive silicon-carbide sintered compact The material of an X-ray generating metal coating layer which covers the part of the graphite body to be impinged on an electron beam and the vicinity thereof, is selected from among materials of high melting points lest the layer should fuse even when irradiated with the electron beam. The X-ray generating metal coating layer is heated up to about 2500° C. in most cases. It is accordingly desirable to select the material from among metals which have high melting points of at least 2500° C. and which generate X-rays. Tungsten or a tungsten-rhenium alloy is very suitable as the material of the X-ray generating metal coating layer. Rhenium alone is not unusable, but it is inferior to the tungsten or the tungsten-rhenium alloy and is very expensive.

Graphite and tungsten readily react to form a carbide. Accordingly, when the graphite body is directly coated with the tungsten or the tungsten-rhenium alloy, the fragile carbide is formed at the boundary of the two, and the coating layer peels off with ease.

For this reason, it becomes necessary that a metal which does not react with the graphite or which hardly reacts therewith is interposed between the graphite body and the coating layer. Also this metal is desirably selected from among metals having high melting points, concretely, melting points of at least 2500° C. lest it should fuse due to the irradiation with the electron beam.

As the material of the metal interlayer, rhenium is the best. The rhenium is approximate to the graphite in the coefficient of thermal expansion, so that thermal stresses are difficult of concentrating in the boundary between the graphite and the rhenium.

The metal interlayer needs to enter pores in the surface of the graphite body and to percolate into the body. By causing the metal interlayer to percolate to the interior of the graphite body in this manner, the X-ray generating metal coating layer can be rendered difficult of peeling off as already stated, and an input with which an X-ray tube can be increased to achieve shortening a diagnosing period of time and clearing a processed image.

Figure 2:
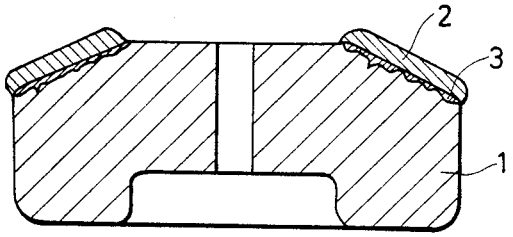

FIGS. 1 and 2 are sectional views showing an embodiment of the X-ray target of the present invention. FIG. 1 is an enlarged view of a part on which an electron beam impinges, and the vicinity thereof, while FIG. 2 is a schematic view of the whole X-ray target.

The surface of a graphite body 1 is partly covered with an X-ray generating metal coating layer 2, and a metal interlayer 3 intervenes between the two and percolates into the graphite body 1.

The metal interlayer 3 is desirably formed so that the maximum percolation depth thereof, namely, the maximum value of the distances between the surface of the graphite body and the inner ends of the percolation parts of the metal interlayer may be at least 10 μm.

As the maximum percolation depth of the metal interlayer is smaller, the X-ray generating metal coating layer becomes more liable to peel off, and it becomes more difficult that the load input of an X-ray tube is increased to shorten a diagnosing period of time or to clear a processed image.

For permitting an X-ray CT system to diagnose details such as a blood vessel, an X-ray target in possession of a heat capacity of or above 1500–2000 kiloheat units (KHU) is required. The X-ray target of the present invention in which the maximum percolation depth of the metal interlayer is at least 10 μm, meets this requirement satisfactorily.

The thickness of the X-ray generating metal coating layer 2 ought to be set greater than a depth by which the electron beam reaches. Since the depth of the penetration of the electron beam is about 10–15 μm, the thickness of the X-ray generating metal coating layer is preferably set greater than 20 μm. Thicknening the X-ray generating metal coating layer unnecessarily, incurs increase in the weight of the X-ray target and forms causes for the ununiform rotation etc. of the X-ray target ascribable to the wear of a bearing at the high-speed rotation thereof. For this reason, the thickness of the X-ray generating metal coating layer is desirably restrained to, at most, about 500 μm and is particularly desirably set at about 50–200 μm.

In the total thickness of the metal interlayer, the thickness of a part covering the surface of the graphite body suffices with at least 3 μm, usually 5–10 μm. The metal interlayer functions as a barrier for preventing the production of a fragile carbide layer on the graphite body, and this function is satisfactorily achieved when the thickness of the metal interlayer covering the surface of the graphite body is 3 μm. In a case where the metal interlayer is thin, the graphite sometimes diffuses through the layer to react with the X-ray generating metal coating layer and to produce a carbide being the product of the reaction at the boundary between the metal interlayer and the X-ray generating metal coating layer. The presence of the carbide in this case, however, does not lead to weakening the adhesion between the X-ray generating metal coating layer and the metal interlayer. Accordingly, the production of such a carbide layer does not pose any problem at all.

In order to better the conductivity of heat from the X-ray generating metal coating layer to the graphite body, it is desirable that the X-ray generating metal coating layer is made of a columnar crystal structure. Such a columnar crystal structure is readily obtained by forming the coating layer by the use of the technique of chemical vapor deposition.

However, in the case where the coating layer has the columnar crystal structure in this manner, fine cracks are prone to appear due to the collisions of the electron beam, and the cracks might evolve to lead to decrease in the amount of X-rays. It is therefore desirable that the X-ray generating metal coating layer is formed of two layers, the top layer of which to be impinged on the electron beam is made of a fine crystal and the bottom layer of which is made of the columnar crystal structure. The fine crystal of the top layer is rendered finer than the underlying columnar crystal.

The top layer of the fine crystal structure can be obtained by controlling the setting conditions of chemical vapor deposition, and can also be obtained by employing the technique of sputtering or thermal spraying.

In general, a pure metal is superior to an alloy in the heat conductivity To the contrary, the alloy is generally higher than the pure metal in the recrystallization temperature, and it can endure a higher temperature when the electron beam is irradiated thereon. It is therefore desirable that the top layer is formed of the alloy, while the underlying columnar crystal is formed of the pure metal. It is very desirable for realizing an X-ray target of large heat capacity and high heat conductivity that the X-ray generating metal coating layer is constructed in a double layer structure which consists of the top layer made of a tungsten-rhenium alloy and the underlying columnar crystal of pure tungsten. Desirably, the composition of the tungsten-rhenium alloy in this case consists of 1–10 weight-% of rhenium, the balance being tungsten.

Figure 3:
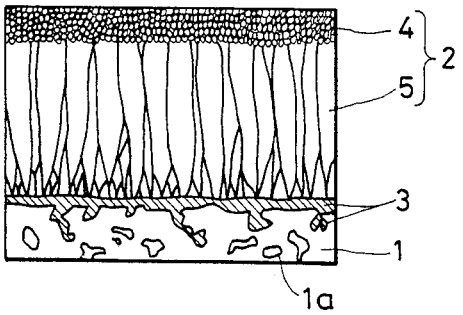
FIG. 3 is a partial enlarged sectional view of an X-ray target according to another embodiment of the present invention.

FIG. 3 shows a partial sectional view of the X-ray target of the present invention having an X-ray generating metal coating layer of double layer structure. The X-ray generating metal coating layer 2 consists of a top layer 4 and a bottom columnar crystal layer 5. Symbol 1*a* denotes the pores of a graphite body 1. The total thickness of the X-ray generating metal coating layer put into the double layer structure in this manner is desired to be 20–500 μm, in which the thickness of the top layer is desired to be about 50–200 μm, while that of the bottom columnar crystal layer is desired to be about 50–300 μm.

Figure 4:
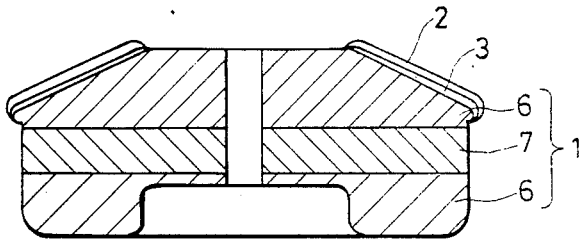
FIG. 4 is a general sectional view of an X-ray target according to another embodiment of the present invention.

FIG. 4 shows an example in which a graphite body 1 is put into a structure having three plates stacked, and a ceramics sintered plate is used as one of the plates. In FIG. 4, numerals 6 indicate graphite plates, and a ceramics sintered plate 7 is sandwiched between the two graphite plates. As the ceramics sintered plate, it is desirable to use a sintered compact of high heat conductivity, for example, a silicon-carbide sintered compact containing beryllia. By employing the structure in which the ceramics sintered plate is sandwiched in this manner, the mechanical strength of the graphite body can be heightened.

(ii) Method of Manufacturing X-ray Target

The graphite body of an X-ray target can be prepared by sintering. The graphite body prepared by the sintering has a large number of pores in its state left intact, and it owns the requisite of the graphite body in the X-ray target of the present invention, namely, the requisite that the graphite body is porous.

In a case where the pores in and near the surface of the graphite body are to be increased more, the surface may be roughened by heating the body in the atmospheric air and thereafter immersing it into hot water, or the pores may well be artificially formed by immersing the body in chemicals. If there is any other suitable expedient for forming the pores, it may well be employed, and the above methods are not restrictive.

Since a metal interlayer must percolate into the pores in and near the surface of the graphite body, it needs to be formed by chemical vapor deposition under a normal pressure or under a pressure close to the normal pressure.

In an experiment in which a metal interlayer was formed by setting the pressure of chemical vapor deposition (CVD) at $10^{-2}$ Torr, the metal interlayer could not be caused to percolate into the graphite body. Thus, it is desirable that the pressure in the case of performing the chemical vapor deposition is kept at or near the normal pressure and is prevented from becoming $10^{-2}$ Torr or below.

In the case of forming the metal interlayer by chemical vapor deposition, it is desirable to keep the graphite body heated, and the maximum percolation depth is conspicuously affected by the heated temperature. The preferable heated temperature of the graphite body is 200°–300° C. When the heated temperature is low, pyrolysis is difficult to proceed, and the metal interlayer cannot be caused to percolate sufficiently into the graphite body. When the heated temperature is too high, the pyrolysis proceeds on only the surface of the graphite body, and the metal interlayer precipitates on the surface of the graphite body and does not percolate thereinto.

It is desirable that an X-ray generating metal coating layer is formed by chemical vapor deposition, sputtering, thermal spraying, or the like. In case of forming the coating layer into a columnar crystal structure, it is desirable to perform the chemical vapor deposition. In case of obtaining a microstructure, it is desirable to perform the sputtering or the thermal spraying.

In a case where the X-ray generating metal coating layer is put into a double layer structure and where a top layer of microstructure and a bottom layer of columnar crystal are formed by a single step, desirably the chemical vapor deposition is adopted, and the composition, pressure, temperature, reducing gas, etc. of a gas for forming the coating layer are controlled during the formation of the top layer.

(iii) Constructions of X-ray Bulb and X-ray Tube

Figure 5:
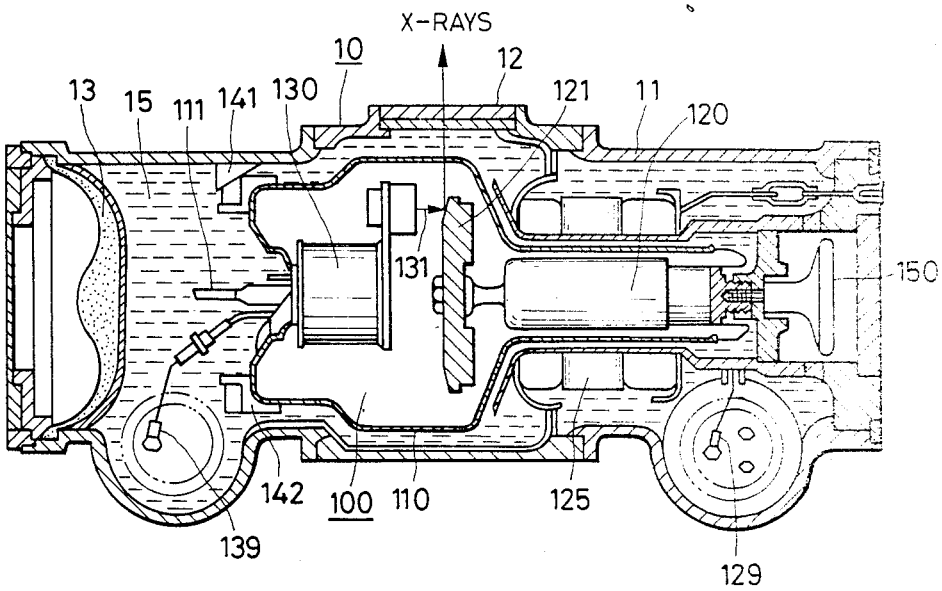
Figure 6:
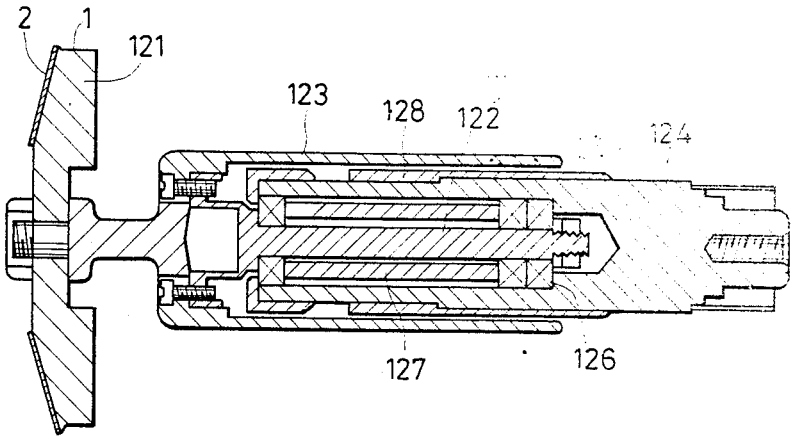
FIG. 6 is a schematic sectional view showing an embodiment of a rotating anode of the present invention.

FIG. 5 shows a schematic sectional view of an X-ray tube according to an embodiment of the present invention, while FIG. 6 shows a schematic sectional view of a rotating anode.

An X-ray tube 10 has an X-ray bulb 100 built in a sealed envelope 11. The surrounding space of the X-ray bulb 100 within the envelope is filled up with a cooling medium 15.

The sealed envelope 11 has an X-ray emission window 12. The X-ray emission window 12 is desired to be, for example, a glass plate the outer surface or inner surface of which is lined with lead slits in such a manner that a part to emit X-rays therethrough is left behind It is desirable that the inner side of the sealed envelope except the X-ray emission window 12 is also lined with an X-ray shielding material, for example, lead plates.

As described also in the official gazette of Japanese patent application Laid-open No. 183861/1986, the X-ray tube generates a large amount of heat simultaneously with the emission of the X-rays. In order to forcibly remove the generated heat, the cooling medium 15 is packed and circulated in the sealed envelope As the cooling medium, a liquid medium, for example, oil is often put in.

The X-ray bulb 100 includes a rotating anode 120 and a cathode 130 within a vacuum tube 110. The vacuum tube 110 is usually formed of a glass tube or metal tube etc. The rotating anode 120 comprises an X-ray target 121, and a mechanism for rotating this X-ray target The rotating mechanism for the X-ray target includes a motor rotor, and has a motor stator 125 at a position outside the X-ray bulb and opposite the rotor. Regarding the rotating mechanism for the X-ray target, a structure closely resembling that of the present invention is described in considerable detail also in Japanese patent application Laid-open No. 183861/1986.

The cathode 130 comprises a filament for emitting an electron beam, and the emitted electron beam 131 irradiates the X-ray target 121 and is radiated through the X-ray emission window 12 of the sealed envelope 11. Numeral 129 designates an anode terminal, and numeral 139 a cathode terminal. In addition, numerals 141 and 142 designate cushions which prevent the X-ray bulb 100 from colliding against the sealed envelope 11 and damaging Numeral 111 indicates a part where the end of the vacuum tube has been finally sealed off after the evacuation of the interior of the tube by vacuum suction, that is, a vacuum sealed-off portion.

In FIG. 5, a lid 13 of rubber is placed on the upper end of the sealed envelope 11. This serves to prevent the cooling medium from leaking out of the X-ray tube even when the tube has broken down due to any cause The rubber lid 13 hinders the outflow of the cooling medium owing to an elasticity inherent in the rubber.

As shown in FIG. 6, the rotating anode 120 comprises the X-ray target 121 and the rotating mechanism therefor. The rotating mechanism has a rotary shaft 122 and a cylindrical rotor 123. As the material of the rotor 123, copper is well suited. The rotary shaft 122 is surrounded with a stationary shaft 124, and a bearing 126, in the concrete, a ball bearing is interposed between the rotary shaft and the stationary shaft. Numeral 127 indicates a stopper for the bearing 126. Besides, numeral 128 indicates a spacer lying between the rotor 123 and the stationary shaft 124. The stationary shaft 124 is fixed to a stationary member 150.

Regarding the structures of the X-ray bulb and the rotating anode, structures resembling those of the present invention are shown also in the official gazette of Japanese patent application Laid-open No. 202643/1985.

For the purposes of shortening a diagnosing period of time and clearing a processed image in relation to an X-ray CT system, it is necessitated to enlarge the X-ray target and to increase the heat capacity thereof. However, when the X-ray target becomes larger in size and heavier in weight, a load on the bearing increases, and wear powder appears from the part of the bearing which slides relative to the rotary shaft, so that the rotary shaft becomes eccentric. Besides, the apperance of the wear powder sometimes lowers the withstand voltage of the X-ray tube and renders the tube unusable.

For these reasons, in the case of employing the large-sized X-ray target, it is required to develop a rotating anode suited thereto or to improve the rotating mechanism. With the X-ray target of the present invention, however, the body is made of graphite, and the X-ray generating materials of heavy weights such as tungsten, rhenium etc. are used in only a part of the surface of the target, so that the target can be assembled and operated in the rotating anode of the structure shown in FIG. 6 and can also achieve a higher heat capacity. The X-ray target of the present invention can endure a load corresponding to a tube current of at least 400 mA and an input power of at least 48 kW.

The X-ray target of the present invention is really epochmaking in the points that it can be assembled and operated in prior-art rotating anodes of very common structures, and that it can achieve a higher heat capacity.

EMBODIMENT 1

By way of trial, there was manufactured a target which comprised a body of graphite, an interlayer of rhenium, and an X-ray generating metal material consisting of a bottom layer of tungsten and a top layer of a tungsten-rhenium alloy. FIG. 3 shows the sectional structure of the surface of the target and the vicinity thereof The graphite body 1 had a large number of pores 1*a*. The metal interlayer 3 was percolating into the pores 1*a* of the surface part of the graphite body 1 and in the shape of a lamina covering on the graphite surface, and was overlaid with the X-ray generating metal coating layer 2 formed of the double layer structure. In fabricating this target, the graphite body 1 was first machined, it was subjected to ultrasonic washing with pure water in order to eliminate the stopping of the pores 1*a* with cut powder having been developed by the machining, etc., and it was subjected to a heat treatment for biscuit in vacuum at 1500° C. Thereafter, using chemical vapor deposition, the rhenium layer of the metal interlayer 3 and the columnar crystal tungsten layer 5 and fine crystal tungsten-rhenium alloy layer 4 as the X-ray generating metal coating layer 2 were formed to be continuous by a single process.

The tungsten-rhenium alloy was composed of 5 weight-% of rhenium, the balance being tungsten The thickness of the alloy layer was 100 μm, and that of the tungsten layer was 200 μm. The thickness of the part of the rhenium layer penetrating the surface of the graphite body was about 10 μm, and the maximum percolation depth of the rhenium layer into the graphite body was about 100 μm. The chemical vapor deposition was carried out by a method in which rhenium fluoride and tungsten fluoride were reduced with hydrogen under a normal pressure. In this regard, the precipitation condition of each of the rhenium fluoride and the tungsten fluoride differs depending upon temperatures, pressures, etc. In the performance of the deposition, therefore, the temperature of the body was adjusted to about 300° C. so that the rhenium of the metal interlayer 3 might sufficiently percolate into the surface pores 1*a* of the graphite body 1. On the other hand, as regards the tungsten, the grain size of a columnar crystal and the ruggedness of a surface enlarge with a temperature rise. Besides, the crystal grain form of the tungsten-rhenium alloy changes depending upon temperatures. Therefore, the columnar crystal layer of the tungsten was formed on the metal interlayer 3 at a substrate temperature of about 550° C., and the fine crystal layer of the tungsten-rhenium alloy was formed thereon at a substrate temperature of about 450° C. The target thus obtained was light in weight, high in thermal radiation and large in heat capacity, and had the graphite body 1 and the metal interlayer 3 bonded securely even under severe service conditions. Therefore, it was free from such problems as peeling and degradation in heat conductivity.

Figure 7:
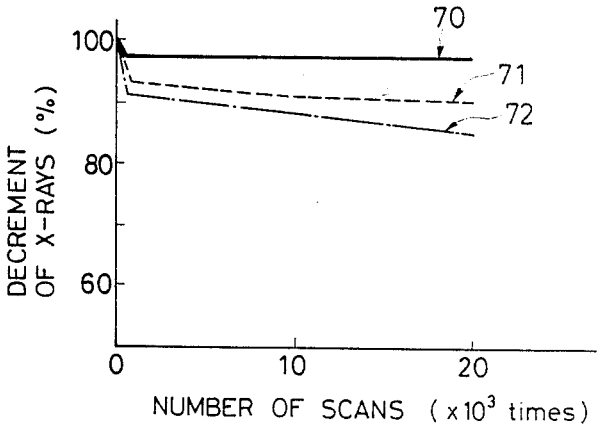
FIG. 7 is a characteristic diagram showing the relationships between the number of scans and the decrement of X-rays in the operations of X-ray tubes in which several kinds of X-ray targets are respectively assembled.

FIG. 7 is a characteristic diagram showing the relationships between the decrement of X-rays and the number of scans as obtained when this X-ray target 70 and prior-art targets were assembled in X-ray tubes of the structure shown in FIG. 5, and the X-rays were generated under a tube voltage of 120 kV and a tube current of 400 mA.

Used as the prior-art targets were a graphite-base target 71 which had such a structure that a tungsten-rhenium alloy layer was formed on a graphite body through a rhenium layer, but that the rhenium layer did not percolate, and a metal target 72 in which a tungsten-rhenium alloy layer was formed on the electron-beam irradiation face of a molybdenum body by sintering.

When, in FIG. 7, the variations in the amounts of the X-rays of the targets under the service conditions of the voltage of 120 kV and the current of 400 mA are read, the target 70 of the present invention is smaller in the decrement of the X-rays than the graphite-base target 71 without the percolation of the rhenium layer and the metal target 72. Moreover, the target of the present invention did not exhibit any appreciable change even when subjected to a great input corresponding to the load of a voltage of 120 kV and a current of 600 mA.

EMBODIMENT 2

Even when, in Embodiment 1, the tungsten-rhenium alloy of the top layer was replaced with fine crystal pure tungsten, similar effects were attained.

EMBODIMENT 3

In a target, the peeling of a metal interlayer and an X-ray generating metal coating layer must not arise due to thermal stresses as already described. Therefore, film forming processes for the metal interlayer and the close adhesion thereof with a graphite body were studied. One of the processes was sputtering, and the other was chemical vapor deposition. First, as regards the sputtering, the film formation of rhenium was carried out by a sputter-down system in which a sputtering rhenium target at a purity of at least 99.9% was arranged above, while the graphite body was arranged below. A sputtering gas was argon, and under a pressure of 0.01 Torr, the rhenium was sputtered into a film on the graphite body to a thickness of about 10 μm. As a result, the percolation of the rhenium into pores peculiar to the graphite body was not noted. Further, as to a film sputtered and formed on a high-density graphite body which was little contaminated and which had a small number of pores, a swelling phenomenon was often noted when the film was subjected to a heat treatment in vacuum at 1000°-1500° C. Accordingly, in the case where the interlayer is provided by the sputtering, especially a method of pre-processing the body, etc. need to be attended to.

Secondly, as regards the chemical vapor deposition, in a case where rhenium is precipitated by, for example, a system in which rhenium fluoride is reduced with hydrogen under a normal pressure, the state of the precipitation of the rhenium into the pores of the graphite body, as well as the rate of the precipitation, and the quality of a rhenium film differ depending upon temperatures. By way of example, at a temperature of about 200°-300° C., a rhenium film having sufficiently percolated into the pores of the surface part of the graphite body is obtained, whereas at 400° C., the rhenium precipitates to be thick on the graphite body, but the percolation thereof into the pores is insufficient. Further, at a higher temperature of 500° C., the rhenium precipitates in a powdery form and becomes a state unsuitable for the interlayer. Accordingly, the close adhesion between the interlayer and the graphite body is excellent in the film prepared by the chemical vapor deposition at the temperature of 200°-300° C.

EMBODIMENT 4

It is considered to employ a composite body in the form in which graphite takes charge of a heat capacity, while a metal, ceramics or the like takes charge of a rotating speed. Therefore, a target shown in FIG. 4 was manufactured by way of trial. The composite body was a laminated body which consisted of graphite plates 6 and a sintered plate 7 of silicon carbide (SiC) containing beryllia (BeO) known as ceramics of high heat conductivity. A compact in which SiC was securely bonded with graphite pieces employed as upper and lower spacers when sintered by a hot press, was machined into the shape of the target. Thereafter, the compact was washed with pure water and heated in vacuum at 1500° C., and a metal interlayer 3 of rhenium and an X-ray generating metal coating layer 2 were provided by chemical vapor deposition. By the way, the X-ray generating metal coating layer 2 on this occasion was a single fine crystal layer made of a tungsten-rhenium alloy. With this target, effects similar to those of Embodiment 1 were attained, and further, the breaking strength against rotations could be heightened double or more.

Industrial Applicability

As stated above, in a target for an X-ray tube according to the present invention, an X-ray generating metal coating layer is difficult of peeling off, and the conductivity of heat from the X-ray generating metal coating layer to a graphite body is favorable. Accordingly, it is well suited as an X-ray target of high heat capacity.

What is claimed is:

1. In a target for an X-ray tube having an X-ray generating metal coating layer at that face of a graphite body which is irradiated with an electron beam; a target for an X-ray tube characterized in that the X-ray generating metal coating layer contains tungsten and has a thickness of at least 20 μm, that a metal interlayer which is non-reactive with graphite is comprised at a boundary between said graphite body and said coating layer, and that said interlayer has a part which percolates into said graphite body over a percolation depth of at least 10 μm.

2. A target for an X-ray tube according to claim 1, characterized in that said x-ray generating metal coating layer is made of a metal which has a melting point of at least 2500° C.

3. A target for an X-ray tube according to claim 1, characterized in that said metal interlayer is made of a metal which has a melting point of at least 2500° C.

4. In a target for an X-ray tube having a tungsten-containing coating layer at that face of a graphite body which is irradiated with an electron beam; a target for an X-ray tube characterized in that an interlayer which is made of rhenium is comprised at a boundary between said graphite body and said tungsten-containing coating layer, that the tungsten-containing coating layer has a thickness of at least 20 μm, and that the interlayer has a part which percolates into said graphite body over a depth of at least 10 μm.

5. In a target for an X-ray tube having a tungsten-rhenium alloy-containing coating layer at that face of a graphite body which is irradiated with an electron beam; a target for an X-ray tube characterized in that an interlayer which is made of rhenium is comprised at a boundary between said graphite body and said coating layer, that the coating layer has a thickness of at least 20 μm, and that the interlayer has a part in which the rhenium percolates into said graphite body over a percolation depth of at least 10 μm.

6. In a target for an X-ray tube having an X-ray generating metal coating layer at that face of a graphite body which is irradiated with an electron beam; a target for an X-ray tube characterized in that said X-ray generating metal coating layer is constructed of a double layer structure, a bottom layer of which has a columnar crystal structure, and that a metal interlayer which is non-reactive with graphite is comprised at a boundary between said bottom layer and said graphite body and percolates into said graphite body.

7. In a target for an X-ray tube having an X-ray generating metal coating layer at that face of a graphite body which is irradiated with an electron beam; a target for an X-ray tube characterized in that said X-ray generating metal coating layer is constructed of a double layer structure, a top layer of which has a fine crystal and a bottom layer of which has a columnar crystal structure, and that a metal interlayer which is non-reactive with graphite is comprised at a boundary between said bottom layer and said graphite body and percolates into said graphite body.

8. In a target for an X-ray tube having an X-ray generating metal coating layer at that face of a graphite body which is irradiated with an electron beam; a target for an X-ray tube characterized in that said X-ray generating metal coating layer is constructed of a double layer structure which consists of a top layer made of a tungsten-rhenium alloy and a bottom layer made of tungsten, and that an interlayer which is made of rhenium is comprised at a boundary between the tungsten bottom layer and said graphite body, said rhenium percolating into said graphite body.

9. A target for an X-ray tube according to claim 8, characterized in that said top layer made of said tungsten-rhenium alloy has a fine crystal.

10. A target for an X-ray tube according to claim 8, characterized in that said tungsten bottom layer has a columnar crystal structure.

11. In a method of manufacturing a target for an X-ray tube, having the step of coating an electron-beam irradiation face of a body made of a sintered graphite compact with an X-ray generating metal layer containing tungsten; said method of manufacturing a target for an X-ray tube characterized in that, before said coating step, a surface of the graphite body is formed with a metal interlayer which is non-reactive with graphite, by subjecting said surface to a chemical vapor deposition under a pressure of or near normal pressure, and that a part of said interlayer is caused to percolate into said graphite body to have a percolation depth of at least 10 μm.

12. In a method of manufacturing a target for an X-ray tube, having the step of coating an electron-beam irradiation face of a body made of a sintered graphite compact with an X-ray generating metal which is a tungsten-rhenium alloy or tungsten; said method of manufacturing a target for an X-ray tube characterized in that, before said coating step, a surface of said body is coated with a rhenium layer by chemical vapor deposition under a pressure of or near normal pressure, and that a part of the rhenium of the interlayer is cause to percolate into said body to have a percolation depth of at least 10 μm.

13. In a method of manufacturing a target for an X-ray tube, having the step of coating an electron-beam irradiation face of a body made of a sintered graphite compact with an X-ray generating metal which is a tungsten-rhenium alloy or tungsten; said method of manufacturing a target for an X-ray tube characterized in that, before said coating step, a surface of said graphite body is coated with a rhenium layer by subjecting said surface to chemical vapor deposition under conditions which satisfy a temperature of 200°-300° C. and a pressure of or near normal pressure, and that a part of the rhenium of the interlayer is cause to percolate into said body to have a percolation depth of at least 10 μm.

14. In a method of manufacturing a target for an X-ray tube, having the step of coating an electron-beam irradiation face of a graphite body with an X-ray generating metal; said method of manufacturing a target for an X-ray tube characterized by comprising before said step, the step of performing chemical vapor deposition under conditions which satisfy a temperature of 200°-300° C. and a pressure of or near a normal pressure, thereby coating a surface of said graphite body with a rhenium layer and causing the rhenium to partly percolate into said body so as to have a part percolating over a percolation depth of at least 10 μm, whereupon a bottom layer of tungsten and a top layer of tungsten-rhenium alloy which construct an X-ray generating metal coating layer of double layer structure are formed in succession.

15. A method of manufacturing a target for an X-ray tube according to claim 14, characterized in that the tungsten bottom layer is formed into a columnar crystal structure by chemical vapor deposition.

16. A method of manufacturing a target for an X-ray tube according to claim 14, characterized in that the tungsten-rhenium top layer is formed into a fine crystal by any of chemical vapor deposition, sputtering, or thermal spraying.

17. In a rotating anode for an X-ray tube having an X-ray target which emits X-rays upon irradiation with an electron beam, and a mechanism which rotates the target; the rotating mechanism including a rotary shaft of the target, a cylindrical motor rotor that is fixed to the rotary shaft, a stationary shaft that surrounds the rotary shaft and supports the rotary shaft, and a bearing that intervenes between the stationary shaft and the rotary shaft; a rotating anode for an X-ray tube characterized in that said X-ray target comprises an X-ray generating metal coating layer with a thickness of at least 20 μm and made of either a tungsten-rhenium alloy or tungsten at an electron-beam irradiation face of a graphite body, and an interlayer of rhenium at a boundary between said coating layer and said body, and that a part of said rhenium of said interlayer percolates into said graphite body over a depth of at least 10 μm.

18. In a rotating anode for an X-ray tube having an X-ray target which emits X-rays upon irradiation with an electron beam, and a mechanism which rotates the target; the rotating mechanism including a rotary shaft of the target, a cylindrical motor rotor that is fixed to the rotary shaft, a stationary shaft that surrounds the rotary shaft and supports this rotary shaft, and a bearing that intervenes between the stationary shaft and the rotary shaft; a rotating anode for an X-ray tube characterized in that said X-ray target comprises an X-ray generating metal coating layer of double layer structure, a top layer of which is made of a tungsten-rhenium alloy and a bottom layer of which is made of tungsten, at an electron-beam irradiation face of a graphite body, and a rhenium layer at a boundary between the tungsten bottom layer and said graphite body, and that the rhenium has a part percolating into said graphite body over a depth of at least 10 μm.

19. In an X-ray bulb having within a vacuum tube a cathode which radiates an electron beam, and a rotating anode which includes an X-ray target for emitting X-trays upon irradiation with the electron beam and a mechanism for rotating the target; the rotating mechanism including a rotary shaft of the X-ray target, a stationary shaft that surrounds the rotary shaft and supports the rotary shaft, and a bearing that intervenes between both the shafts; an X-ray bulb characterized in that said X-ray target comprises an X-ray generating metal coating layer with a thickness of at least 20 μm and made of either a tungsten-rhenium alloy or tungsten and an electron-beam irradiation face of a graphite body, and an interlayer of rhenium at a boundary between said coating layer and said body and that a part of said rhenium of the interlayer percolates into said graphite body over a depth of at least 10 μm.

20. In an X-ray bulb having within a vacuum tube a cathode which radiates an electron beam, and a rotating anode which includes an X-ray target for emitting X-rays upon irradiation with the electron beam and a mechanism for rotating the target; the rotating mechanism including a rotary shaft of the X-ray target, a stationary shaft that surrounds the rotary shaft and supports this rotary shaft, and a bearing that intervenes between both the shafts; an X-ray bulb characterized in that said X-ray target comprises an X-ray generating metal coating layer of double layer structure, a top layer of which is made of a tungsten-rhenium alloy and a bottom layer of which is made of tungsten, at an electron-beam irradiation face of a graphite body, and a rhenium layer at a boundary between the tungsten layer and said graphite body, and that the rhenium has a part percolating into said graphite body over a depth of at least 10 μm.

21. In an X-ray tube having an X-ray bulb, and a cooling medium which fills up the space around an X-ray bulb within a sealed envelope which has an X-ray emission window; the X-ray bulb including within a vacuum tube a cathode which radiates an electron beam, and a rotating anode that includes an X-ray target for emitting X-rays upon irradiation with the electron beam and a mechanism for rotating the target; the rotating mechanism including a rotary shaft of the X-ray target, a stationary shaft that surrounds the rotary shaft and supports the rotary shaft, and a bearing that intervenes between both the shafts; an X-ray tube characterized in that said X-ray target comprises an X-ray generating metal coating layer with a thickness of at least 20 μm and made of either a tungsten-rhenium alloy or tungsten at an electron-beam irradiation face of a graphite body, and an interlayer of rhenium at a boundary between said coating layer and said body and that a part of said rhenium of said interlayer percolates into said graphite body to a depth of at least 10 μm, said X-ray tube withstanding a load which corresponds to a tube current of at least 400 mA and an input power of at least 48 kW.

22. In an X-ray tube having an X-ray bulb, and a cooling medium which fills up a space around the X-ray bulb, within a sealed envelope which has an X-ray emission window; the X-ray bulb including within a vacuum tube a cathode that radiates an electron beam, and a rotating anode that includes an X-ray target for emitting X-rays upon irradiation with the electron beam and a mechanism for rotating the target; the rotating mechanism including a rotary shaft of the X-ray target, a stationary shaft that surrounds the rotary shaft and supports this rotary shaft, and a bearing that intervenes between both the shafts; an X-ray tube characterized in that said X-ray target comprises an X-ray generating metal coating layer of double layer structure, a top layer of which is made of a tungsten-rhenium alloy and a bottom layer of which is made of tungsten, at an electron-beam irradiation face of a graphite body, and a rhenium layer at a boundary between the tungsten layer and said graphite body, and that the rhenium percolates into said graphite body, said X-ray tube withstanding a load which corresponds to a tube current of at least 400 mA and an input power of at least 48 kW.

23. An X-ray tube according to claim 22, characterized in that said tungsten layer has a columnar crystal structure.

24. An X-ray tube according to claim 22, characterized in that the tungsten-rhenium alloy layer has a fine crystal.

25. A target for an X-ray tube according to claim 1, characterized in that a part of the interlayer covering the surface of the graphite body has a thickness of at least 3 μm.

26. A target for an X-ray tube according to claim 4, wherein a part of the interlayer covering the surface of the graphite body has a thickness of at least 3 μm.

* * * * *